US007911443B2

(12) United States Patent
Lin

(10) Patent No.: US 7,911,443 B2
(45) **Date of Patent: *Mar. 22, 2011**

(54) DRIVING-CONTROL DEVICE AND METHOD OF BACKLIGHT MODULE

(75) Inventor: Feng-Li Lin, Taishan Township (TW)

(73) Assignee: Gigno Technology Co., Ltd., Taipei (TW)

( * ) Notice: Subject to any disclaimer, the term of this patent is extended or adjusted under 35 U.S.C. 154(b) by 826 days.

This patent is subject to a terminal disclaimer.

(21) Appl. No.: 11/896,255

(22) Filed: Aug. 30, 2007

(65) Prior Publication Data

US 2008/0055233 A1 Mar. 6, 2008

(30) Foreign Application Priority Data

Aug. 31, 2006 (TW) ..... 95132244 A
Aug. 20, 2007 (TW) ..... 96130724 A

(51) Int. Cl.
*G09G 3/36* (2006.01)

(52) U.S. Cl. ..... 345/102; 345/82; 345/204

(58) Field of Classification Search ..... 345/82, 345/102, 204; 362/97.1, 97.2
See application file for complete search history.

(56) References Cited

U.S. PATENT DOCUMENTS

2006/0170452 A1* 8/2006 Benavides et al. ..... 326/37
2007/0257869 A1* 11/2007 Huang et al. ..... 345/82

* cited by examiner

*Primary Examiner* — Amare Mengistu
*Assistant Examiner* — Premal Patel
(74) *Attorney, Agent, or Firm* — Birch Stewart Kolasch & Birch, LLP

(57) ABSTRACT

A driving-control device of a backlight module receives a first digital burst signal and includes a start signal generating unit, a counter unit, a memory unit, a comparator unit and a driving unit. The start signal generating, unit generates a digital start signal on receiving the first digital burst signal. The counter unit is electrically connected to the start signal generating unit and sequentially generates counting values on receiving the digital start signal. The memory unit stores at least one target counting value. The comparator unit is electrically connected to the counter unit and the memory unit and sequentially generates triggering signals according to the counting values and the target counting value. The driving unit is electrically connected to the comparator unit and outputs sequentially delayed driving signals on receiving the triggering signals.

19 Claims, 6 Drawing Sheets

DRIVING-CONTROL DEVICE AND METHOD OF BACKLIGHT MODULE

CROSS REFERENCE TO RELATED APPLICATIONS

This Non-provisional application claims priority under 35 U.S.C. §119(a) on Patent Application No(s). 095132244 filed in Taiwan, Republic of China on Aug. 31, 2006, and 096130724 filed in Taiwan, Republic of China on Aug. 20, 2007, the entire contents of which are hereby incorporated by reference.

BACKGROUND OF THE INVENTION

1. Field of Invention

The invention relates to a driving-control device and a driving-control method of a backlight module, and, in particular, to a driving-control device and a driving-control method of a backlight module having a sequential flashing function.

2. Related Art

Nowadays, liquid crystal displays (LCD) are being used widely. They can be found on computer monitors, touch-screens for man-machine interface and home televisions. As popularity grows, its technical performance becomes more demanding in parameters such as viewing angle, contrast ratio, color saturation, and response time.

Among all the performance parameters, quick response time has always been one of the most sought-after items in improving motion picture quality. Low quality LCD with slow response time often causes picture blurring while viewing moving objects. This may not be a major issue if the LCD is just for a desktop computer monitor on which most of the pictures are still all the time. However, if the LCD is for home televisions, quicker response time is a must.

Besides the response time, there is a fundamental technical issue, the display type (or mode), that limits the LCD motion picture quality. The CRT display device, the predecessor of LCD, displays pictures by tracing out the images on a glass screen with a single scanning electron beam. Therefore, at any given moment, only a small fraction of the glass screen will be lightened while being scanned across by the electron beam. CRT display device cannot hold still the complete picture to be displayed on the glass screen. Actually, it displays pictures dot-by-dot and line-by-line. This is referred to as impulse-type display. LCD displays pictures in a different way. The LCD screen is composed of numerous pixels arrayed in rows and columns. Each pixel stores a graphic data. To display a picture, the LCD screen loads pixel data of a complete frame in parallel. Each pixel keeps its graphic data until being reloaded. At any given time, every pixel of the entire screen is lightened. Hence, LCD can hold still the complete picture to be displayed, so it displays pictures frame-by-frame. This is referred to as holding-type display.

A major drawback of holding-type display is the picture blurring caused by frame switching when displaying moving objects. Because the previous frame will never completely disappear from the screen before the next frame comes in. The most straightforward way to solve this problem is to make the previous frame disappear completely by inserting an extra dark frame before the next frame comes in. This will require some efforts on graphic processor. Another simpler solution is to shut off the backlight module of the LCD device for a specific period of time to create a momentary dark image. This dark image neutralizes human eyes from the previous frame and makes them ready to accept the next one. This is referred to as flashing backlight technology. To further eliminate blurring of holding-type display and mimic impulse-type display, an LCD backlight module is divided into several light zones. Each zone can be turned on and off sequentially. A specific control timing sequence is used to turn on and off each light zone. This timing sequence is synchronized to the frame data reload timing to optimize the motion picture quality. This is referred to as sequential flashing backlight technology. Since this sequential flashing backlight technique turns on and off a number of individual light zones, this can also be applied to power-saving and brightness-dimming control.

In some related arts, analog phase delay array is adopted to do the backlight on/off control. However, the timing sequence is adjusted by altering resistance or capacitance value of the control circuit. Therefore, it is an important subject to provide a digital programmable control for making the timing adjusting easier.

SUMMARY OF THE INVENTION

In view of the foregoing, the invention is to provide a digital programmable control for making the timing adjusting easier To achieve the above, this invention discloses a driving-control device of a backlight module. The backlight module firstly receives a first digital burst signal. The driving-control device includes a start signal generating unit, a counter unit, a memory unit, a comparator unit and a driving unit. The start signal generating unit generates a digital start signal on receiving the first digital burst signal. The counter unit is electrically connected to the start signal generating unit and starts counting to generate a counting value whenever the start signal is generated. The memory unit stores at least one target counting value. The comparator unit is electrically connected to the counter unit and the memory unit and generates triggering signals whenever the counter value matches the target counting value. The driving unit is electrically connected to the comparator unit and outputs sequentially delayed driving signals on receiving the triggering signal.

To achieve the above, this invention also discloses a backlight driving-control method that includes the following steps of: generating a digital start signal on receiving a first digital burst signal, activating a counter unit to count so as to generate a counting value on receiving the digital start signal, comparing the counter value with at least one target counting value to generate at least one triggering signal, and outputting sequentially delayed driving signals on receiving the triggering signal.

As mentioned above, the driving-control device and the method of the backlight module of the invention have the following advantages. The comparator unit is utilized to compare the counting values generated by the counter unit with the target counting value stored in the memory unit to generate the sequentially delayed driving signals. Thus, when the light emitting units of the backlight module are driven by the sequentially delayed driving signals, the light emitting units can be sequentially lighted so that the light emitting units alternately light on and off. In other words, the impulse-type display may be simulated using the simple digital circuit design in accordance with the driving-control device and the method of the backlight module of the invention, and the blurring phenomenon may be reduced.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
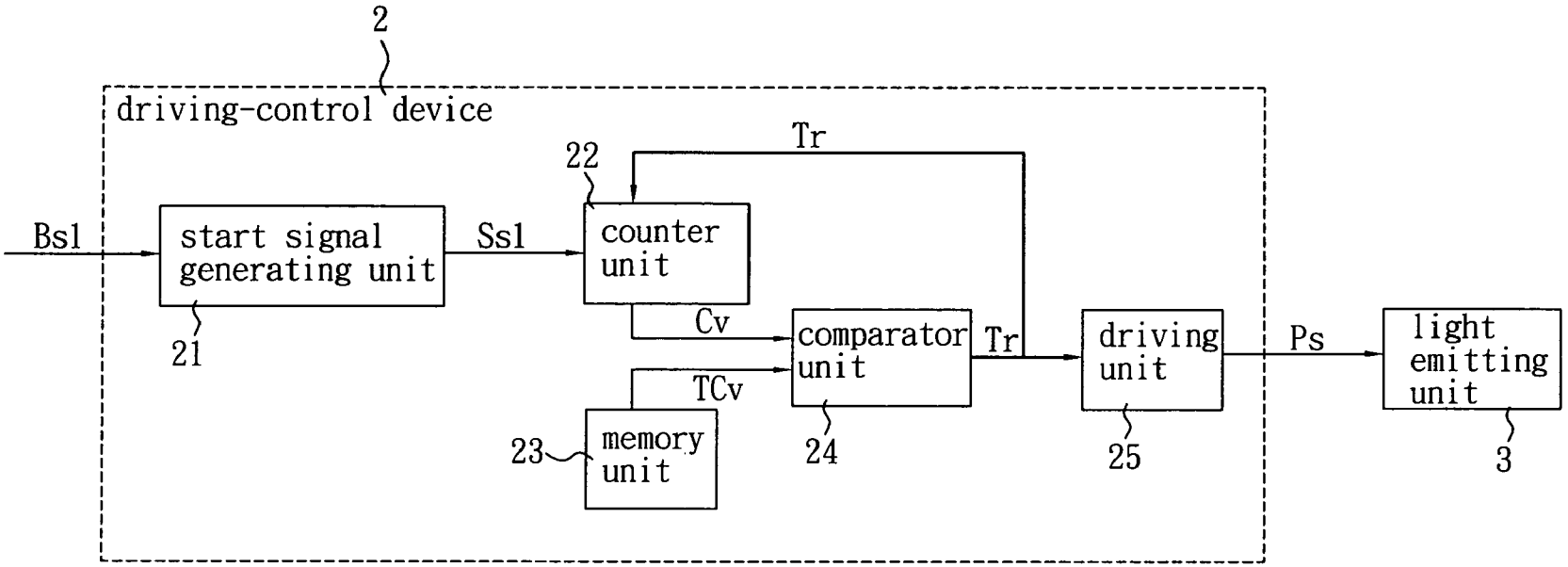
FIG. 1 is a schematic view showing a driving control device of a backlight module according to a preferred embodiment of this invention.
Figure 2:
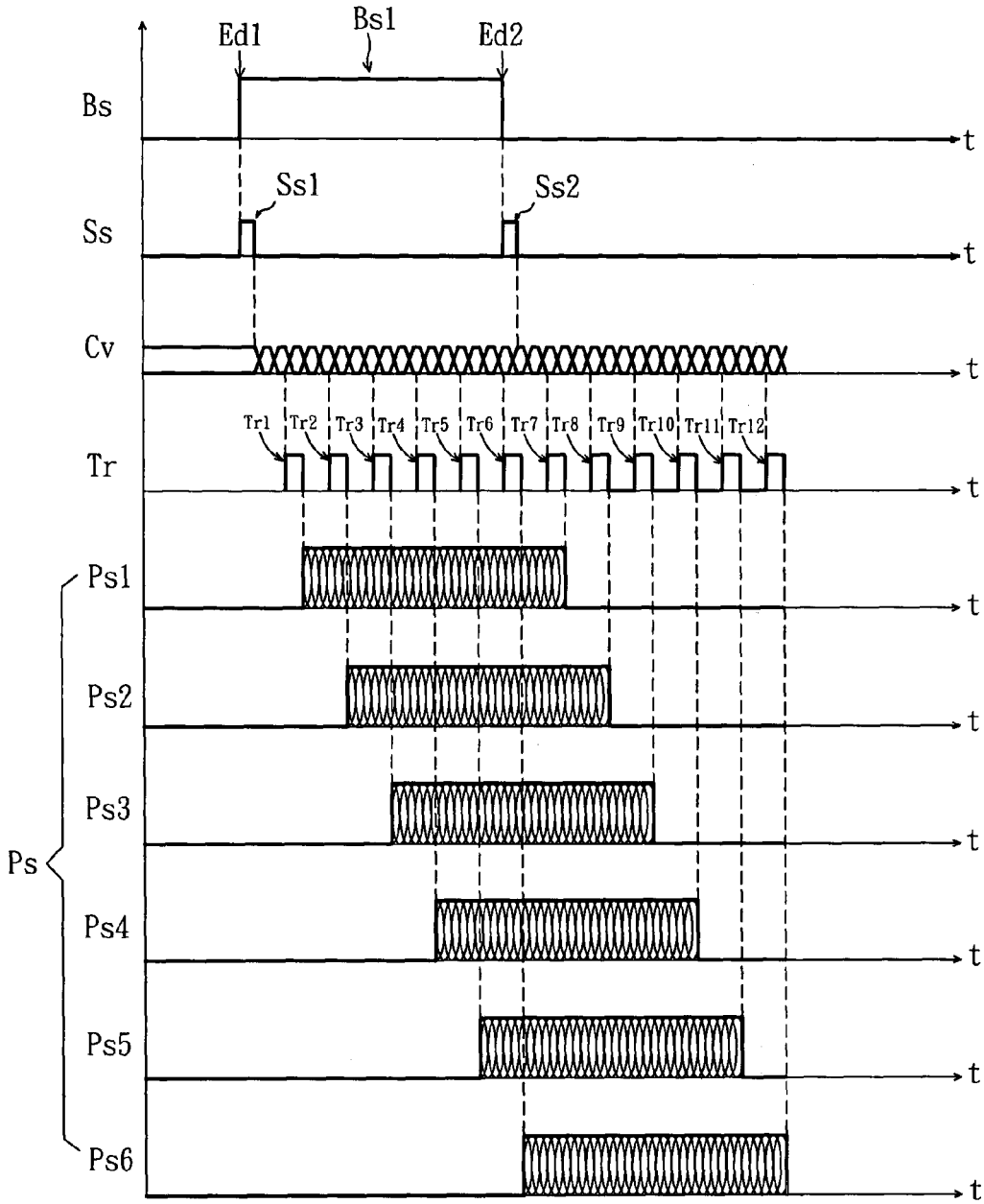
FIG. 2 is a timing diagram for the driving control device in FIG. 1.

Referring to FIGS. 1 and 2, a driving-control device 2 of a backlight module according to a preferred embodiment of this invention includes a start signal generating unit 21, a counter unit 22, a memory unit 23, a comparator unit 24 and a driving unit 25. The driving-control device 2 receives a first digital burst signal Bs1 and outputs a series of sequentially delayed driving signals Ps to a plurality of light emitting units 3, wherein the light emitting unit 3 may be a cold cathode fluorescent lamp (CCFL), a hot cathode fluorescent lamp (HCFL) or a light emitting diode (LED). In this embodiment, the driving-control device 2 drives six light emitting units 3, for example.

In this embodiment, the start signal generating unit 21 generates the digital start signal Ss1 on receiving a start triggering edge Ed1 of the first digital burst signal Bs1 (see FIG. 2). In addition, the start signal generating unit 21 may further generate a digital end signal Ss2 on receiving an end triggering edge Ed2 of the first digital burst signal Bs1.

The counter unit 22 is electrically connected to the start signal generating unit 21, and starts to count on receiving the digital start signal Ss1 for generating counting values Cv. If the counter unit 22 is a 4-bit counter, it may count from 0000 to 1111. If the counter unit 22 is a 2-bit counter, it may count from 00 to 11. In this embodiment, the 2-bit counter is illustrated as an example. In addition, the counting unit 22 also starts to count after receiving the digital end signal Ss2. Herein, it is to be noted that the counting unit 22 may also be implemented by a timer.

The memory unit 23 stores at least one target counting value TCv. If the counter unit 22 is a 4-bit counter, the target counting value TCv may range from 0000 to 1111. If the counter unit 22 is a 2-bit counter, the target counting value TCv may range from 00 to 11.

The comparator unit 24 is electrically connected to the counter unit 22 and the memory unit 23. Whenever the counting value Cv matches the target counting value TCv, the comparator unit 24 generates a triggering signal Tr. In this embodiment, the counter unit 22 will be reset after the triggering signal Tr is generated. That is, after the counter unit 22 receives the triggering signal Tr outputted from the comparator unit 24, it starts to count again from 00. In this embodiment, six light emitting units 3 are illustrated. Hence, there are six activating triggering signals Tr1 to Tr6 and six de-activating triggering signals Tr7 to Tr12.

The driving unit 25 is electrically connected to the comparator unit 24 and outputs the sequentially delayed driving signals Ps on receiving the triggering signals Tr. Herein, a time delay exists between subsequent two sequentially delayed driving signals. The driving unit 25 sequentially outputs six delayed driving signals Ps1 to Ps6 for respectively driving those six light emitting units 3 so that the light emitting units 3 turn on and off alternately.

The driving unit 25 activates the delayed driving signal Ps1 on receiving the activating triggering signal Tr1. Similarly, on receiving the activating triggering signals Tr2 to Tr6, it activates delayed driving signals Ps2 to Ps6. Then, the driving unit 25 de-activates the delayed driving signal Ps1 on receiving the de-activating triggering signal Tr7. Similarly, on receiving the de-activating triggering signals Tr8 to Tr12 it de-activates the delayed driving signals Ps2 to Ps6.

Figure 3:
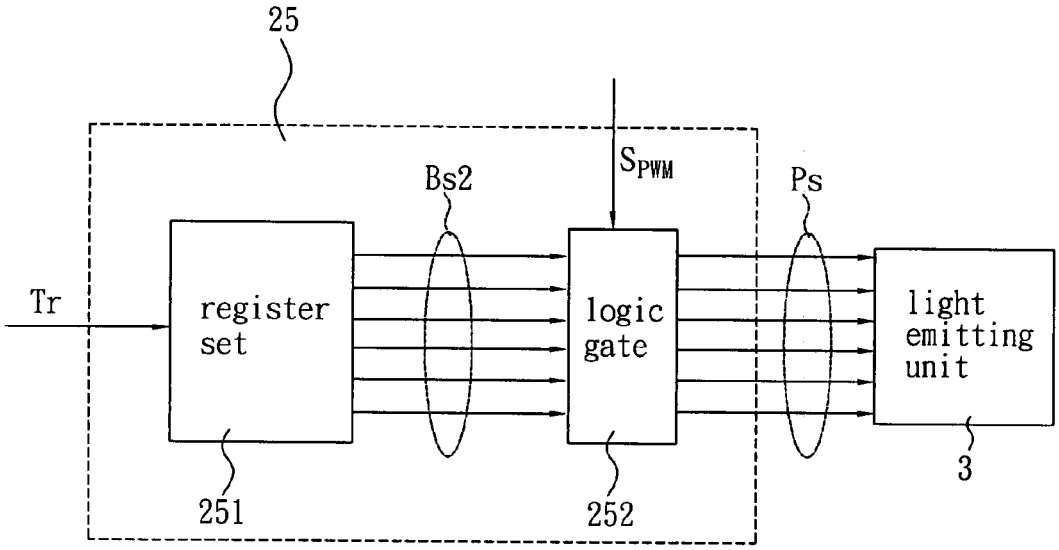
FIG. 3 is a block diagram showing a driving unit of the driving control device according to the preferred embodiment of the invention.

Referring again to FIG. 3, the driving unit 25 of the driving-control device 2 further includes a register set 251 and a logic gate array 252. The register set 251 is electrically connected to the logic gate array 252. The register set 251 sequentially outputs second digital burst signals Bs2 on receiving the triggering signals Tr, and the logic gate array 252 generates the sequentially delayed driving signals Ps on receiving the second digital burst signals Bs2 and a digital pulse width modulation (PWM) signal $S_{PWM}$. The frequency of the second digital burst signal Bs2 is lower than that of the digital pulse width modulation signal $S_{PWM}$. For example, the frequency of the second digital burst signal Bs2 is 120 Hz, and the frequency of the digital pulse width modulation signal $S_{PWM}$ is 50 KHz.

Figure 4:
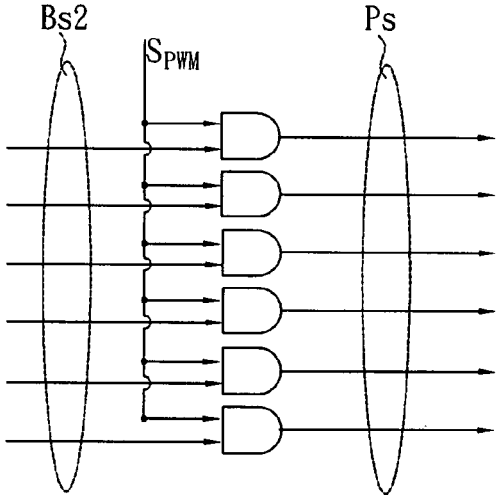
FIG. 4 is a schematic view showing a logic gate array of the driving unit in FIG. 3.

As shown in FIG. 4, the logic gate array 252 of this embodiment includes six AND gates $G_1$ to $G_6$, the second digital burst signals Bs2 outputted from the register set 251 are inputted to the AND gates $G_1$ to $G_6$, respectively, and the digital pulse width modulation signal $S_{PWM}$ is also inputted to the AND gates $G_1$ to $G_6$, respectively. The AND gates $G_1$ to $G_6$ may output the sequentially delayed driving signals Ps on receiving the second digital burst signal Bs2 and the digital pulse width modulation signal $S_{PWM}$.

Figure 5:
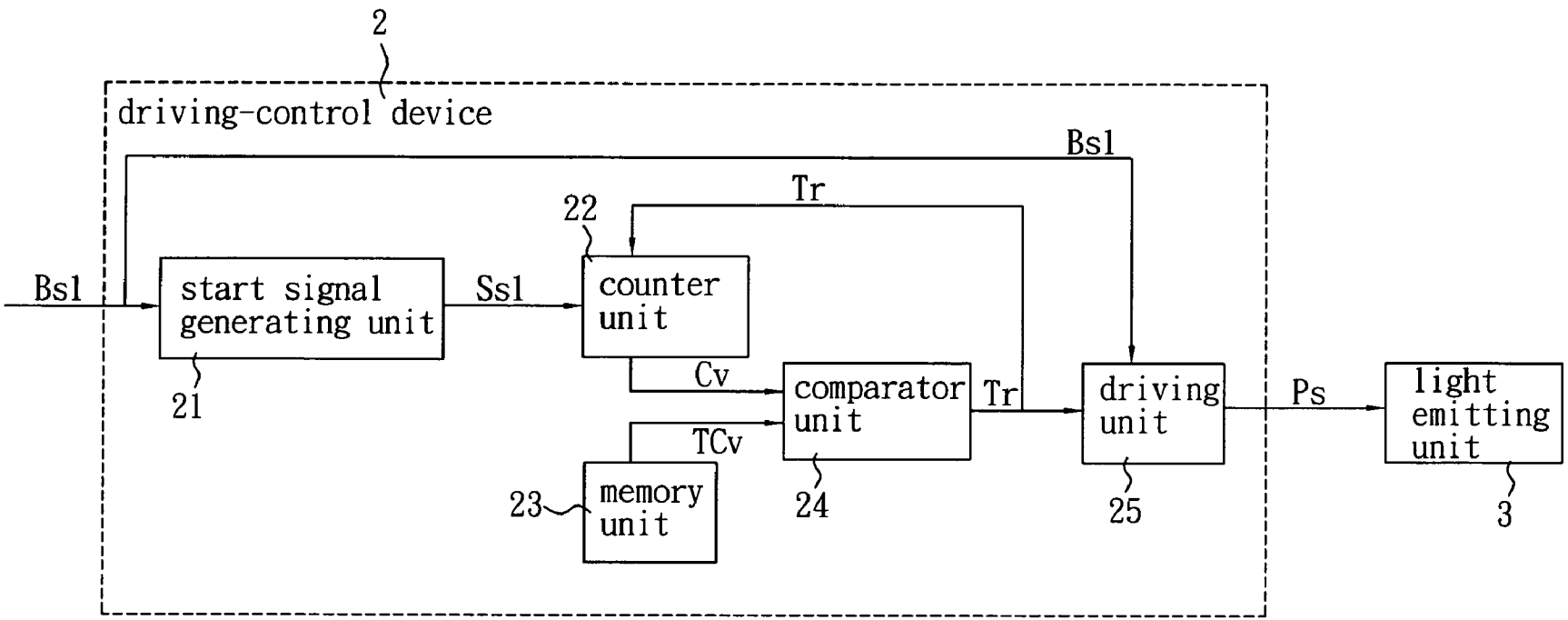
FIG. 5 is a schematic view showing another driving-control device according to another preferred embodiment of the invention.
Figure 6:
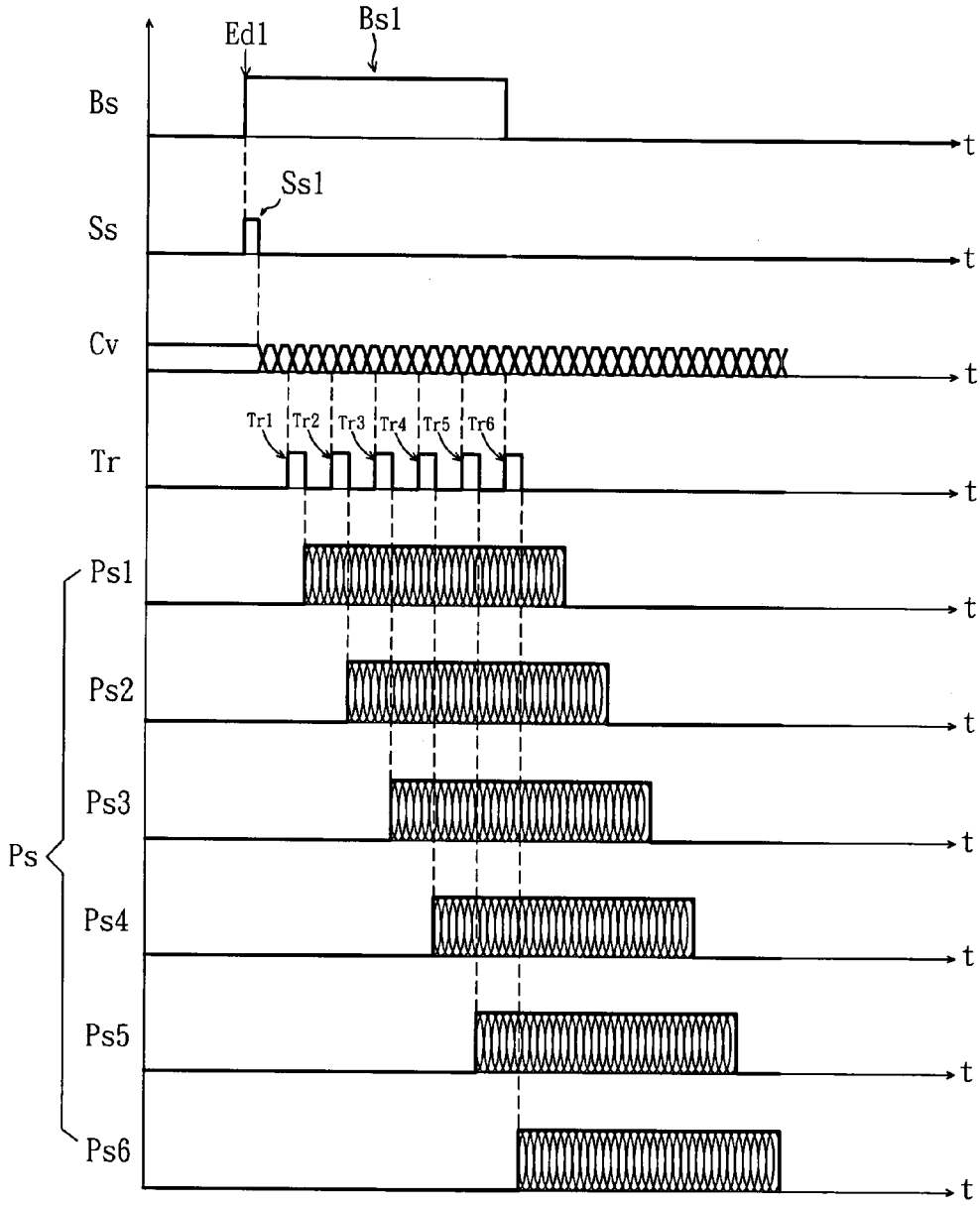
FIG. 6 is a timing diagram for the driving-control device in FIG. 5.

As shown in FIGS. 5 and 6, a driving-control device according to another preferred embodiment of the invention includes the start signal generating unit 21, the counter unit 22, the memory unit 23, the comparator unit 24 and the driving unit 25. The driving unit 25 receives the first digital burst signal Bs1, and only the triggering signals Tr1 to Tr6 are outputted from the comparator unit 24 as shown in FIG. 5. After sequentially receiving the start triggering signals Tr1 to Tr6 and the first digital burst signal Bs1, the driving unit 25 sequentially outputs the second digital burst signals Bs2. The second digital burst signals Bs2 are just delayed versions of the first digital burst signals Bs1.

Figure 7:
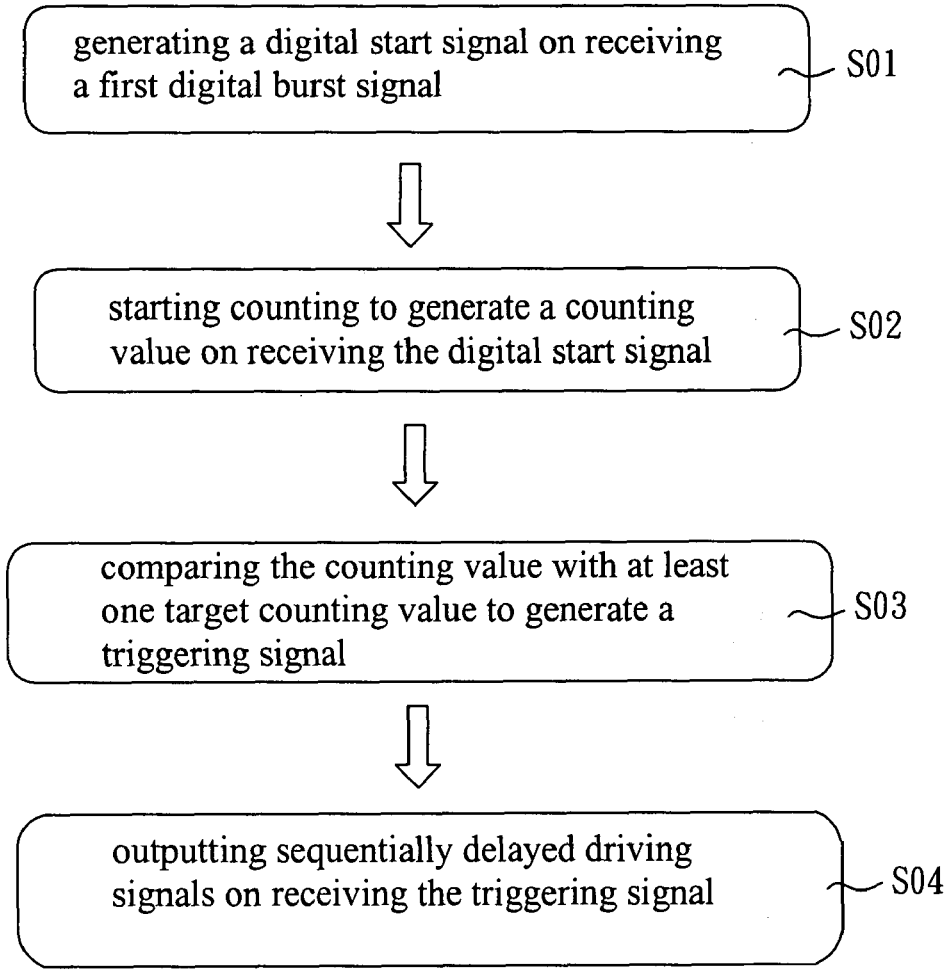
FIG. 7 is a flow chart showing a driving-control method according to the preferred embodiment of the invention.

Referring to FIG. 7, a driving-control method of a backlight module according to the preferred embodiment includes the following steps.

In step S01, a digital start signal is generated on receiving a first digital burst signal. Step S02 is to start counting to generate a counting value on receiving the digital start signal. In step S03, the counting value is compared with at least one target counting value TCv to generate a triggering signal. In step S04, sequentially delayed driving signals are outputted on receiving the triggering signal.

The detailed driving-control method and variations thereof have been described in the above-mentioned embodiments, so detailed descriptions thereof will be omitted.

Hereinafter, a summary of this work is given. To improve LCD picture quality, a sequential flashing driving control and method is developed in this invention. It includes a counter unit, a comparator unit, a memory unit and a driving unit. The counter unit receives a triggering signal and starts counting. The memory unit stores at least one target counting value. The comparator unit compares the counting value of the counter unit with the target counting value stored in the memory unit. Once these two values matching each other, a sequentially delayed driving signal will be generated. The counter unit can be reset and re-triggered multiple times to generate a group of sequentially delayed driving signals. These sequentially delayed driving signals drive the light emitting units of the backlight module. Therefore, the light emitting units can be sequentially turned on. In this way, LCD motion picture quality can be improved by turning its holding-type display characteristic into CRT-like impulse-type display. Still in this way, since the light emitting units are turned on alternately, a power-saving scheme can be designed using the sequential flashing technique disclosed in this invention.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A driving-control device of a backlight module for receiving a first digital burst signal, the driving-control device comprising:

a start signal generating unit for generating a digital start signal on receiving the first digital burst signal;

a counter unit, electrically connected to the start signal generating unit, for starting counting to generate a counting value whenever the digital start signal is generated;

a memory unit for storing at least one target counting value;

a comparator unit, electrically connected to the counter unit and the memory unit, for generating triggering signals whenever the counting value matches the target counting value; and a driving unit, electrically connected to the comparator unit, for outputting sequentially delayed driving signals on receiving the triggering signals.

2. The driving-control device according to claim 1, wherein a time delay exists between sequential two of the sequentially delayed driving signals.

3. The driving-control device according to claim 1, wherein the counter unit is electrically connected to the comparator unit and receives the triggering signals to reset and start counting again.

4. The driving-control device according to claim 1, wherein the driving unit comprises:

a register set for outputting a second digital burst signals on receiving each of the triggering signals; and a logic gate array, electrically connected to the register set, for generating the sequentially delayed driving signals on receiving the second digital burst signals and a digital pulse width modulation signal.

5. The driving-control device according to claim 4, wherein the logic gate array comprises a plurality of AND gates.

6. The driving-control device according to claim 4, wherein the frequency of the second digital burst signal is lower than the frequency of the digital pulse width modulation signal.

7. The driving-control device according to claim 1, further comprising a plurality of light emitting units, wherein the driving unit sequentially transmits the sequentially delayed driving signals to the light emitting units.

8. The driving-control device according to claim 7, wherein each of the light emitting units is a cold cathode fluorescent lamp (CCFL), a hot cathode fluorescent lamp (HCFL) or a light emitting diode (LED).

9. The driving-control device according to claim 1, wherein the triggering signals comprise at least one activating triggering signal and at least one de-activating triggering signal.

10. The driving-control device according to claim 9, wherein the driving unit activates one of the sequentially delayed driving signals with the activating triggering signal and de-activates the sequentially delayed driving signal with the de-activating triggering signal.

11. The driving-control device according to claim 1, wherein the driving unit generates the sequentially delayed driving signals according to the triggering signals and the first digital burst signal.

12. A driving-control method of a backlight module, the method comprising the steps of:

generating a digital start signal on receiving a first digital burst signal;

activating a counter unit to count so as to generate a counting value on receiving the digital start signal;

comparing the counting value with at least one target counting value to generate at least one triggering signal; and outputting sequentially delayed driving signals on receiving the triggering signal.

13. The driving-control method according to claim 12, wherein the triggering signal is generated when the counter value matches the target counting value.

14. The driving-control method according to claim 12, further comprising the step of:

sequentially resetting the counter unit and starting the counter unit to count again so as to generate the counting value on receiving the triggering signals.

15. The driving-control method according to claim 12, further comprising the step of:

sequentially outputting a second digital burst signal on receiving the triggering signal.

16. The driving-control method according to claim 15, further comprising the step of:

generating the sequentially delayed driving signals on receiving the second digital burst signal and a digital pulse width modulation signal.

17. The driving-control method according to claim 12, wherein the triggering signals comprise an activating triggering signal for activating one of the sequentially delayed driving signals.

18. The driving-control method according to claim 12, wherein the triggering signals comprise a de-activating triggering signal for de-activating the one of the sequentially delayed driving signals.

19. The driving-control method according to claim 12, further comprising the steps of:

transmitting the sequentially delayed driving signals to a plurality of light emitting units.

* * * * *